US005314367A

United States Patent [19]

Schaefer

[11] Patent Number: 5,314,367

[45] Date of Patent: May 24, 1994

[54] MARBLE TOY

[76] Inventor: Nicholas E. Schaefer, 29801-B Fir Dr., Evergreen, Colo. 80439

[21] Appl. No.: 862,296

[22] Filed: Apr. 2, 1992

[51] Int. Cl.[5] ..... A63H 29/08; A63B 67/14; A63D 3/02

[52] U.S. Cl. ..... 446/168; 273/108; 273/120 R; 273/153 S

[58] Field of Search ..... 446/166, 167, 168, 169, 446/170, 171, 172; 273/108, 109, 111, 112, 113, 115, 116, 120 R, 121, 153 S

[56] References Cited

U.S. PATENT DOCUMENTS

| | | | |
|---|---|---|---|
| 424,321 | 3/1890 | Ludlum et al. | 273/116 |
| 451,958 | 5/1891 | Swett | 273/113 |
| 553,824 | 2/1896 | Bartlett | 273/111 |
| 555,288 | 2/1896 | Keiser | 273/111 |
| 777,205 | 12/1904 | Henry | 273/115 |
| 899,402 | 9/1908 | Howell | 273/115 |
| 1,544,411 | 6/1925 | Kern | 273/112 |
| 1,933,406 | 10/1933 | Bardocz | 273/120 R |
| 3,011,787 | 12/1961 | Modica, Jr. et al. | 273/109 |
| 3,677,547 | 7/1972 | Hicks | 273/153 S X |
| 4,871,173 | 10/1989 | Lammertink | 273/153 S |

*Primary Examiner*—David N. Muir
*Attorney, Agent, or Firm*—Frank L. Zugelter

[57] ABSTRACT

A toy (10) comprising an elongated block (12) which is carved out to form one or more patterns (30) for a path along which marbles (15) are propelled by a person's finger through a slot (17) communicating with a channel (14) in any one of such patterns (30) which are interlinked to provide continuity in rolling motion for the marbles (15). Pivoting gates (50) across the path or at intersections of the channels (14) forming patterns (30) provide means to determine the direction of motion for marbles (15), including "dead ending" the marble in its own channel. Various features in the path patterns provide impetus or an inertial bar to the marbles' motion.

25 Claims, 3 Drawing Sheets

FIG. 4.
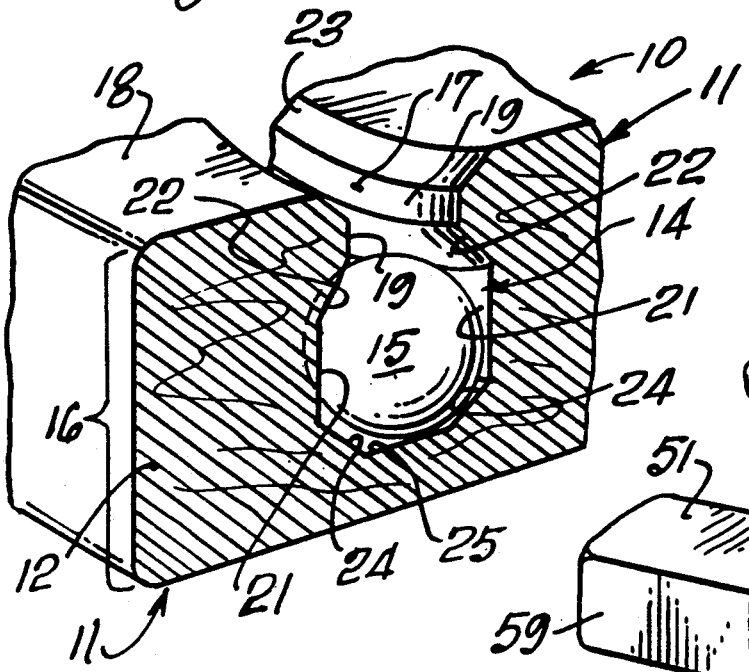
FIG. 5.
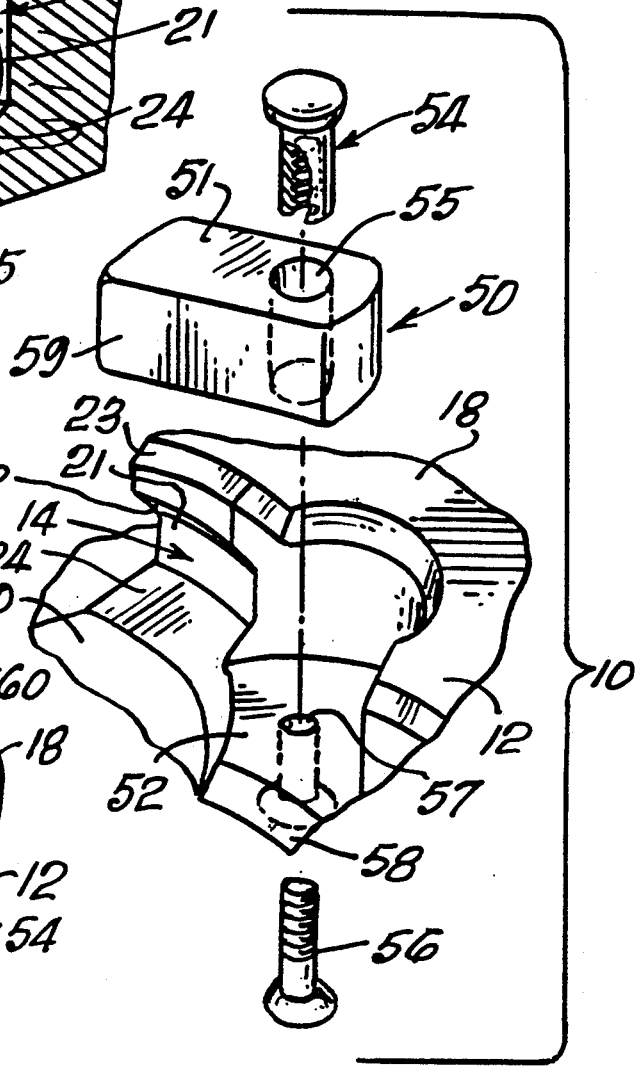
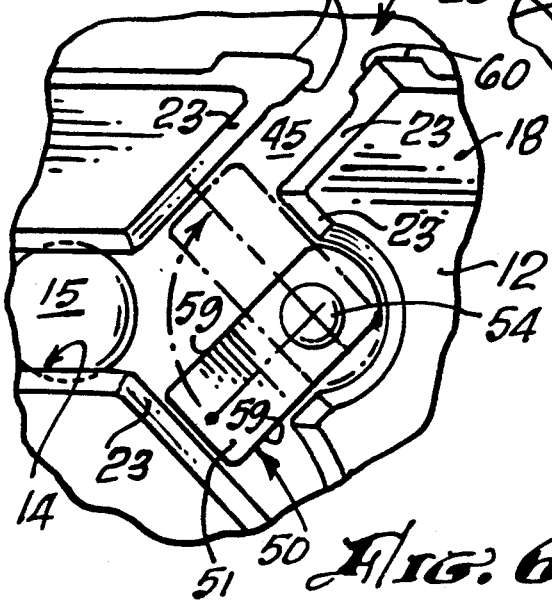
FIG. 6.

MARBLE TOY

TECHNICAL FIELD

This invention relates to a toy, and is particularly directed to an amusement toy and learning tool for children.

PRIOR ART BACKGROUND

All considered toys and games of this type are disclosed in the following U.S. Pat. Nos., hereby made of record, 1,544,512; 2,401,455; 2,466,116; 3,768,810.

SUMMARY OF INVENTION

This invention comprises a frame or form, such as a block, having a configuration or thickness sufficient to embrace the fullness of one or more channels or conduits below a slot in communication therewith, and which provides an endless path or a continuity of sub-paths forming an endless path for a marble or marbles or other rollable members, and to which one's finger can be applied to propel the marble through one or more such channels and sub-paths, to thereby complete the child's amusement, in the visibility of the action of marbles or to assist the child in learning logic skills in general, by observing the motions of things, as the marbles roll from one point or location to another. A plethora of patterns for the marbles' path can be provided in the toy, not to be limited by the illustrated FIGURES accompanying this disclosure, and are interlinked to provide continuous motion for a marble(s) from one pattern to another. Means for determining the direction of the motion of such spherical or rollable members in a pattern or into a different pattern from another pattern vis-a-vis propelling such member along the same pattern in one or both directions all the time, is provided. Also, one or some longitudinal portions of the walls and floors forming the channels are inclined, causing the marble or marbles to continue to roll along its path to the lowest point of inclination in a particular pattern. This notion of a lowest point or spot is also generated at one or more particular spots along the length of any one or more of the patterns of the toy and where the marble or marbles, depending upon the force of propulsion provided to it or them, collect in or accumulate in pockets recessed in the floor, or continue to roll along the pattern to the same or another location or destination.

Objects of this invention are to provide amusement and/or learning to a child or another and amusement to an adult.

Another object of this invention is to provide a toy that is safe and not dangerous, or susceptible to misuse whereby a child or another would be injured.

Another object of the invention is to provide an inexpensive toy, readily producible by today's computerized manufacturing techniques for producing wooden and plastic and other materialed toys.

These and other objects and advantages will become more apparent upon a full and complete reading of the following description, together with the appended claims thereto and the accompanying drawings comprising three (3) sheets of eight (8) FIGURES.

BRIEF DESCRIPTION OF THE DRAWING

FIG. 4 is a view taken on line 4—4 of FIG. 1, modified to show a perspective view of a fragmentary portion of the toy, showing a rollable member captured in its channel.

FIG. 5 is an exploded perspective view of a means in the toy for directing motion of a rollable member from one pattern to another.

FIG. 6 is a plan view of a directing means installed in the toy.

BEST MODE FOR CARRYING OUT THE INVENTION

Figure 1:
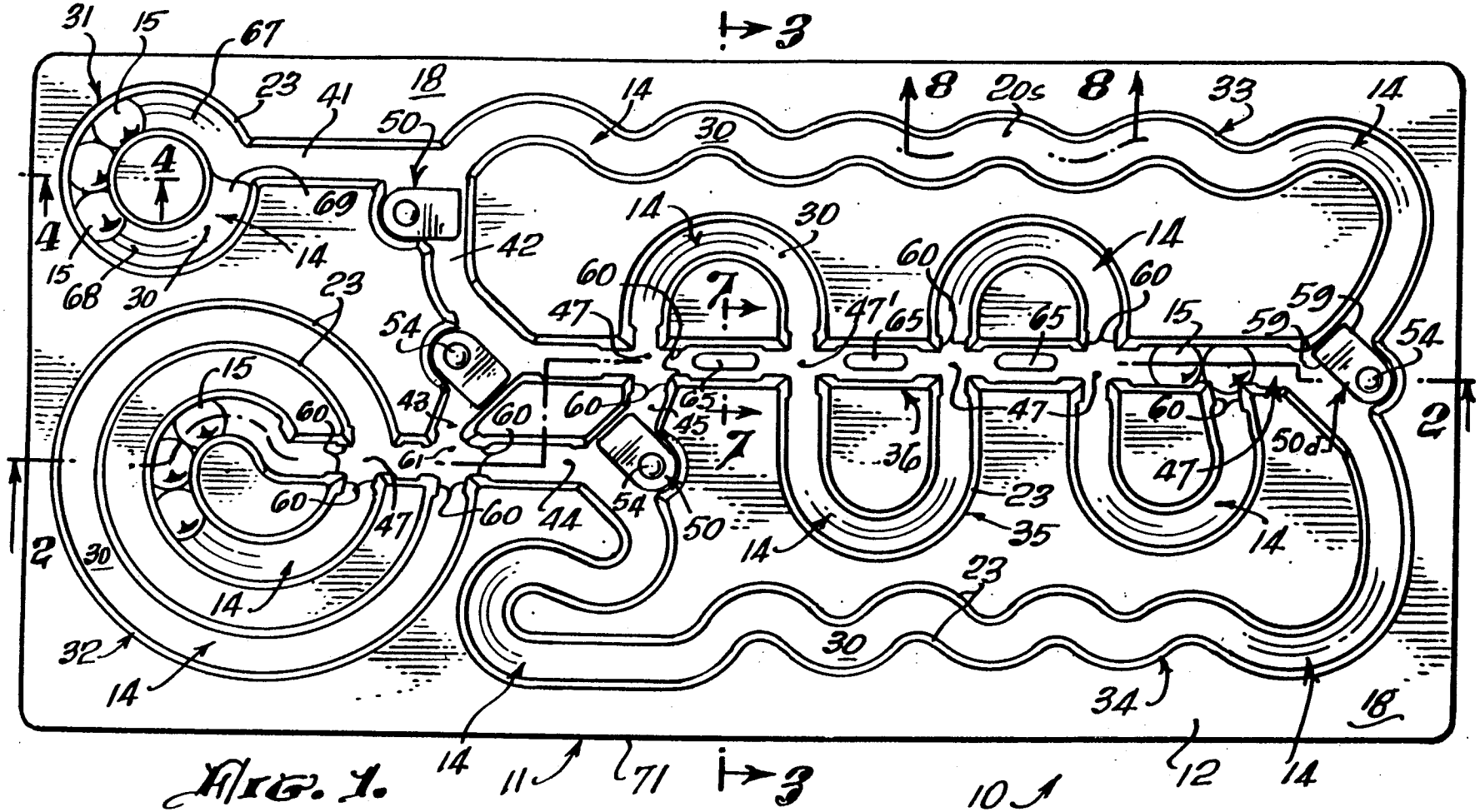
FIG. 1 is a plan view of a toy embodying the invention.

Referring now to the drawing wherein reference characters therein correspond to like numerals hereinafter, reference character 10 denotes a toy embodying the present invention. Toy 10, FIG. 1, comprises a frame or form 11, such as a wooden block 12, having a configuration that embraces the fullness of a channel 14 which provides for one or more patterns along which one or more rollable members 15, such as marbles, can be propelled by a simple push by a finger (not shown) of a person, child or adult, amusing himself or learning logic skills via motion in the play of toy 10. In the illustrated embodiment, frame or form 11 takes on the form of the wooden block 12, preferably of rectangular and elongated geometry and having a generally uniform thickness (or third dimension) 16 in which channels 14 are disposed. A slot 17 is formed through a top surface 18 in block 12 above each channel 14, and which communicates with each channel 14 by means of its opposing walls 19 and with the exterior of toy 10 in order that the person's finger can enter the slot and thence to a channel to propel one or more members 15 along its path in one or more patterns.

Each channel 14, FIG. 4, comprises a floor 20 and spaced walls 21, these walls 21 rising to meet the slot 17. Between each of the walls 21, the walls 19 which form, slot 17 includes in themselves or as distinctly fashioned elements, a wall 22 of narrower or narrowing dimension. Wall 22 provides a dimension to slot 17 that is less than the widest breadth or diameter for a rollable member 15, so that each member 15 is captured within its channel and is prevented from escaping through slot 17 while assuring that it travels its path formed by floor 20 and walls 21. A bevel 23 is provided at top surface 18 to remove any sharpness in toy 10 and for a finger to access marbles 15 in an easier manner. In a preferred manner of construction, inclined surfaces 24 are provided to connect floor 20 to walls 21, and support at two (2) points each marble 15 rather than having such member 15 engage a flat portion 25, FIG. 4, of floor 20. Thus, only two (2) points of contact are made for each marble 15, via surfaces 24, thereby reducing rolling friction between the marble and the material out of which channel 14 is formed, while spaced walls 21 provide the direction or path along which such marbles roll. Also, narrowing walls 22 are disposed such that just slight play for each marble 15 exists between them and surfaces 24. This construction however is not necessarily or preferably carried out at direct intersections between channels or at locations where means for directing marbles are installed, as will become more apparent in the description hereinafter.

A plurality of geometrical or other patterns 30 for the marbles' path are incorporated within toy 10. FIG. 1 illustrates such a plurality, and in the illustrated embodiment, such plurality comprises a circularly-formed pattern 31, a spirally-wound pattern 32, a wavy pattern 33, a snake-like pattern 34, a sinusoidal configuration for pattern 35, and an elongated or generally straight configured pattern 36. Pattern 36, as will be more fully described hereinafter, can also be viewed as a sinusoidal pattern taken along a plane that parallels top surface 18. These patterns are disposed within the three dimensions of the frame or form 11, or block 12, such that each is continuously interlinked with one or more other patterns, as FIG. 1 clearly demonstrates. Pattern 31 is linked by a channel linkage 41 to pattern 33. Pattern 33, at its one end, is linked to either pattern 31 as indicated, or to pattern 36 via a channel linkage 42, and at its other end is linked to the other end of pattern 36. Pattern 32 is linked at its one end by a channel linkage 43 to either pattern 36 or channel linkage 42 and at its other channel end 44 to either pattern 34 or by a channel linkage 45 to one channel end of pattern 35. Pattern 35 at its other channel end is linked to the other channel end of pattern 36. It may be noted about pattern 32 that it includes ingress and egress for marbles 15 through either linkage 43 or its channel end 44, whereas in the case of pattern 31 marbles 15 have but one ingress or egress through the single linkage 41.

In some instances of linking one pattern to one or more other patterns, no interconnecting linkage or linkages are strictly required. This is illustrated by pattern 35 crossing pattern 36 to form direct intersections 47 between themselves, such direct intersections not being necessarily located then at or limited to the ends of the interconnected patterns. Also, note that a direct intersection 47 for a channel 14 in a single pattern is established as well, as is illustrated in pattern 32. It now is apparent that one or more marbles 15 are capable of continuously rolling in either direction in either a single pattern or from a channel in one pattern to one or more channels 14 in other patterns, depending, however, upon which way a means or gate 50 towards which a marble or marbles are rolling is pivoted.

Each gate 50 constitutes a means for determining the direction of the motion of one or more marbles 15 along a pattern 30 chosen or selected, by its pivoting into one of three positions. Means 50 in the illustrated embodiment takes the form of an arm or pointer 51 pivotally mounted, say, conveniently, on a shelf 52 carved out of or formed in block 12 from its top surface 18 in a location not interfering with a continuity of rolling of marble(s) 15 at a point of juncture of or linkage between two or more patterns, or between a pattern or patterns and a channel linkage. A suitable threaded fastener 54 seats in a bore 55 in pointer 51, to be secured to its securing counterpart 56 that is counter-sunk upwardly through a hole 57 in a bottom portion 58 of block 12. Pointer 51 includes a length and width sufficiently long and wide, respectively, to close off a pattern or channel linkage, as illustrated in FIG. 1 in three (3) locations in one manner, as well as closing off a pattern or channel linkage in terms of a "dead end" therefor and as illustrated at **50*d*, FIG. 1. The third or middle position 50*d* for means 50 places the free end of arm 51** across a facing channel or channel linkage, so that the path of the marble "dead ends" against the gate irrespective of in which channel the marble is rolling. Thus, a marble's further motion is confined to its sub-path in the same pattern but in the opposite direction after being stopped at such dead end.

It is to be noted, FIGS. 5, 6, that only at the locations at which means 50 are mounted can members 15 be either placed within or removed from the channels or their linkages, but only when means 50 itself is not mounted in toy 10. Thus, a child of elementary years or other person cannot dislodge the marble from toy 10 and in some manner use it or toy 10 to cause self-injury or injury to another. Thus, the same effective restriction for marble(s) 15 produced by the lesser-dimensioned slot 17 is in place at each of the locations for the swinging pointer 51, each side wall 59 of pointer 51 cooperating with corresponding but distal ones of the contiguous walls 21, 22, 24 that are in parallel opposition to its corresponding side wall 59, FIG. 6, irrespective of in which of the two pivoted positions pointer 51 is placed, FIGS. 1 and 6. Further, it is to be noted that in the construction of toy 10, the width of the slot 17 is effectively restricted at the four (4) corners forming each of the direct intersections 47 by further narrowing as at 60 the opposing walls 19 which form slot 17 above channel(s) 14. The narrowing at 60 provides for the diagonals at each intersection 47 to be less than the widest breadth or diameters of a rollable member 15, less such member be capable of escaping from toy 10 through such intersection. The narrowings 60 also are applied for walls 19 along the channel linkages 41, 42, 43 and channel end 44 in the vicinities of their corresponding proximate determining means 50, as shown in FIG. 1.

Figures 2, 3, 7, 8:
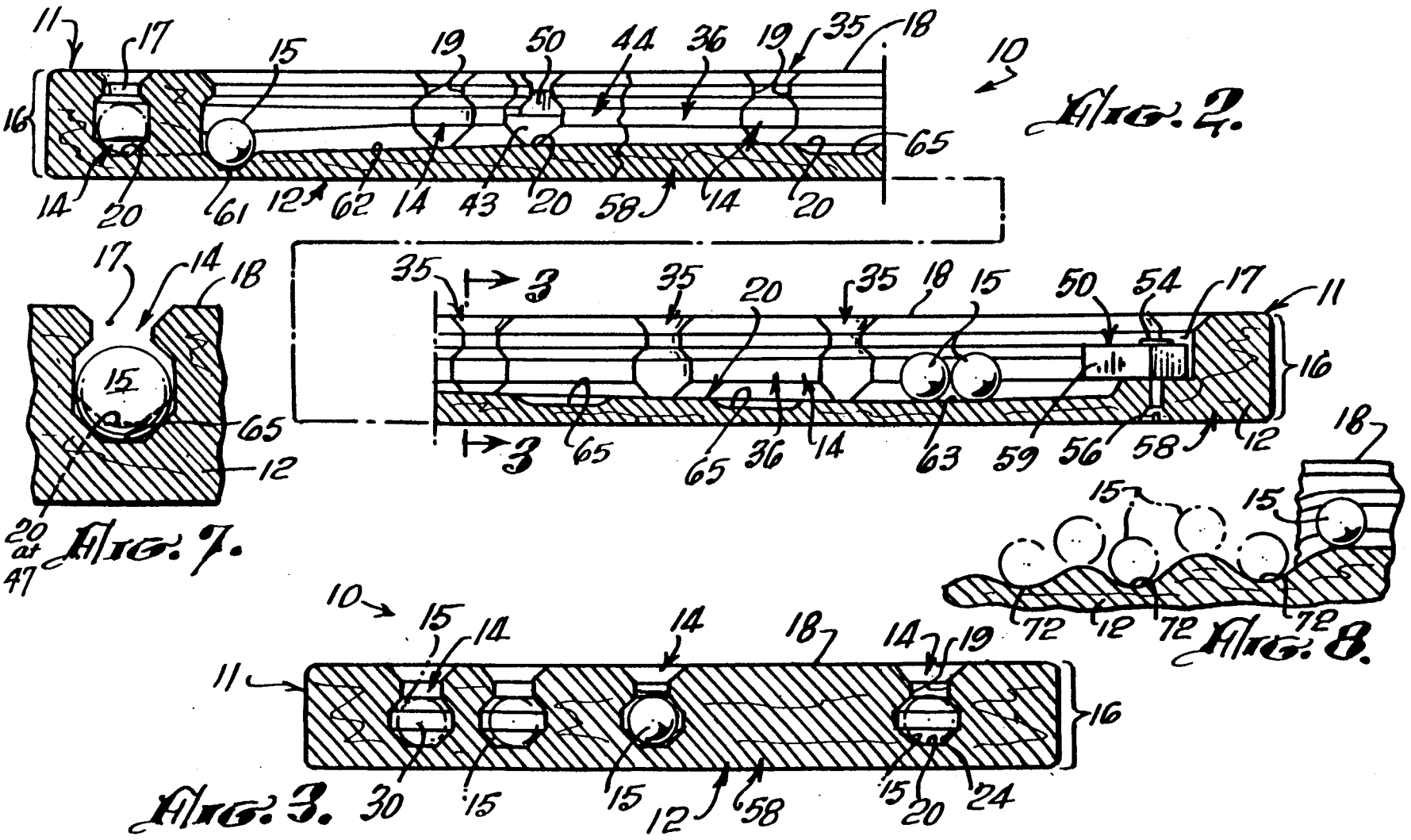
FIG. 2 is a view taken on line 2—2 of FIG. 1.
FIG. 3 is a view taken on line 3—3 of FIG. 2.
FIG. 7 is a view taken on line 7—7 of FIG. 1.
FIG. 8 is a schematic and magnified diagram of a view taken along line 8—8 of FIG. 1.

Turning to FIG. 2, it will be observed that a lowest disposition 61 in the path for a marble in pattern 32 occurs in pattern 32 at an end of an inclination 62 in channel 14 and where marbles 15 accumulate or collect. Although slight in a horizontal view, inclination 62 is provided throughout the pattern's spiral length.

It will be observed that in pattern 36, FIG. 2, another lowest disposition 63 in the path for a marble or marbles is provided in channel 14, for accumulation or collection of one or more marbles 15.

It should be understood that these lowest dispositions in the path for marbles in the channels are not only generated by a general inclination along the length of the floors of the channels, but they also can be generated within block 12 by including specifically one or more formed or carved out recesses 65 disposed along any desired point in any of the channels and their floors. FIGS. 1 and 7 illustrate this particular feature 65. Again, it should be understood that feature 65 is not necessarily limited to pattern 36.

Various features which add to the amusement by the rolling motion of marbles 15 are included in one or more of channels 14 forming one or more plurality of patterns 30. In pattern 31, FIG. 1, the marble's path's lowest disposition 67 opposes its highest disposition 68 in the circularly-configured channel 14. A delineated mesa 69 is formed in floor 20 at the channel's juncture with channel linkage 41. The effect of this construction is that marbles 15 entering pattern 31 from channel linkage 41 will rotate counter-clockwise, being deflected to such counter-clockwise course by mesa 69, and then tend to accumulate/collect at low disposition 67 in their path. On the other hand, should one or more marbles 15 continue to roll counter-clockwise through high disposition 68 and approach and go by mesa 69, they continue to roll counter-clockwise around pattern 31 rather than directing themselves into linkage channel 41. However, should accumulated marble(s) 15 in pattern 31 be caused to roll in a clockwise fashion, as they approach linkage channel 41, their path is directed into such channel 41, towards the immediately adjacent gate 50, mesa 69 deflecting them in that direction.

The channel 14 in pattern 33 includes a floor, FIGS. 1, 8, which dips to troughs at the same depth or level from peaks of varying descending heights right to left, FIG. 8. The direction of the channel right to left also proceeds in a helically-wound manner towards channel linkage 41 to provide an appearance of a wavy pattern. Nevertheless its floor includes a sinusoidal shape 20*s* in reference to the center point of the marbles 15 rolling therealong, i.e., the sinusoidal geometry of motion for the marbles occurs in a plane perpendicular to top surface 18 and extending along the longer dimension 71, FIG. 1, of board 12. Thus, stop points 72 (in the troughs) for marbles are provided along the length of channel 14 in pattern 33 and at which marbles can come to rest as well as rolling through them, depending upon the degree of propulsion on the marble or marbles as they reach those stop points 72. It should be understood about FIG. 8 that it is but a schematic view of troughs and descending peaks thereto that are included along the entire pattern 33, and not to be limited in actual practice of construction to that portion shown between lines 8—8 in FIG. 1. FIG. 8 is a condensed version of a sinusoidal floor 20*s* that in actual practice of construction may take up the entire length of its particular channel in the floor in the pattern or only of a portion of such channel in the floor. Nor need the troughs, and likewise the peaks, be equi-distant between themselves.

As to pattern 35, FIG. 1, it includes a floor 20 having a generally constant slope, right to left on board 12.

In pattern 36, the notion of stop points is further carried out by providing spaced elongated pockets in floor 20, described as pockets 65 above, again, for providing stopping for one or more marbles 15.

With inclusion of these various features immediately described above, the floor 20 at the intersections 47 and 61, and those where the locations for gates 50 mesh with the floors 20, nevertheless are at the same levels with one another to provide a smooth continuing roll of the marbles through such intersections.

In operation with block 12, say, setting on a table (not shown) one's finger (not shown) is placed behind a marble 15, by itself or at the back end of a plurality or string of them, in a channel 14, by thrusting finger through slot 17 to engage the marble, wherever it is in its path. The finger then provides a force of propulsion for the marble or its string, which then freely rolls along its channel 14. The position of the means or gates 50 determines whether the marble or its string thereof rolls into one or another pattern, or "dead ends" in its own pattern. A game between two persons may even be developed, with the goal being to get to a particular point in channel 14. Block 12 may even be universally tilted to produce the same rolling effect, thereby again providing amusement to its user(s). The positions of one or more gates 50 may be changed, so as to cause marble or string thereof to continue along the path provided by channel 14 but along a different pattern or patterns of movement along the marbles' path.

In assembly, one or more marbles 15 are introduced into any one or more of the channels 14 at the locations where means or gates 50 are thereafter pivotally mounted in their respective locations.

Toy 10 is constructed preferably out of wood, using present day numerical control (NC) techniques installed as data in computer programs to form or carve out the voids forming the body formations described above, and which NC techniques for woodworking are state of the art. Without the gates in place, the wood cutting tool gains access to the block to form the channel, slot and linkages. Block 12 may be of different materials such as plastic or other suitable materials, using known techniques to form the indicated voids. Block 12 with its voids also can be cast from metal. Marbles are well known in the art, and the rollable members need not be limited thereto but may be made out of suitable materials other than that for marbles, such as wood or plastic.

Various modifications and changes can be made in toy 10 without departing from the scope and spirit of the appended claims hereto. The patterns for the marble(s)' path and the features in them need not copy those illustrated in the drawing, but may take other shape or form as well or desired, being suitably interlinked and defined or as described as above or in other suitable or known ways. The description of this disclosure's path includes a plurality of paths should the patterns of path be viewed as a plurality of paths, as one or more marbles or the like may be caused to roll along at the same time either in one or in more than one particular pattern. The width of arm 51 may be minimized so that the "dead end" effect is negated. And for purposes of the claims, where applicable, the body formations for slots 17 include the spatial dimensions or diagonals forming the intersections 47 and the walls 59 of gate 50 in relation to their cooperating opposing walls 21.

INDUSTRIAL APPLICABILITY

The invention can be used as an amusement toy for all ages and as a learning tool for children in elementary years of growth.

I claim:

1. A toy for rolling one or more members therein the toy in combination with a plurality of generally spherical rollable members captured in the toy yet being accessible for manipulation, the toy comprising a block of material having a surface in which a series of slots is formed, channel means having spaced walls and a floor formed within said block below the slots with which the channel means communicates, the slots having a dimension less than that between said spaced walls thereby capturing said one or more rollable members in the channel means, the channel means forming a path featuring a plurality of geometrical patterns, one or more of said patterns intersecting at least another of said patterns, and means for determining the direction for said one or more rollable members mounted in said channel means at the intersecting of said one or more of said patterns with at least another of said patterns.

2. The toy of claim 1 wherein a diagonal is formed in the toy at the intersecting of one or more of said patterns with at least another of said patterns, said diagonal being less than the breadth of the rollable member to prevent the latter from escaping through the diagonal.

3. The toy of claim 2 wherein at least one of said patterns includes lowest and highest dispositions for the rollable member.

4. The toy of claim 3 including a stop point for a rollable member at the lowest of said dispositions.

5. The toy of claim 1 wherein said determining means comprises a pivotal gate in the form of a pointer having a free end, a length and a width of the pointer, either the pointer's free end or length blocking one or another of the geometrical patterns.

6. The toy of claim 1 wherein said channel means includes channel linkages, said determining means positioned in the channel means in said channel linkages.

7. The toy of claim 6 wherein said determining means comprises a pivotal gate in the form of a pointer having a free end, a length and a width on the pointer, either the pointer's free end or length blocking one or another of the geometrical patterns.

8. The toy of claim 1 or claim 5 or claim 6 or claim 7 wherein one of said patterns comprises a circularly-formed pattern.

9. The toy of claim 1 or claim 5 or claim 6 or claim 7 wherein one of said patterns comprises a spirally-wound pattern.

10. The toy of claim 1 or claim 5 or claim 6 or claim 7 wherein one of said patterns comprises a wavy pattern.

11. The toy of claim 1 or claim 5 or claim 6 or claim 7 wherein one of said patterns comprises a snake-like pattern.

12. The toy of claim 1 or claim 5 or claim 6 or claim 7 wherein one of said patterns comprises a sinusoidal configuration.

13. The toy of claim 1 or claim 5 or claim 6 or claim 7 wherein one of said patterns comprises a straight configured pattern.

14. A toy for rolling one or more rotatable members that would be captured therein yet accessible for manipulation, the toy comprising a block of material having a surface in which a series of slots is formed, channel means having spaced walls and a floor formed within said block below the slots with which the channel means communicates, said slots being open for accessing said channel means, said slots having a dimension less than that between said spaced walls thereby capturing while nevertheless providing accessing for manipulation of one or more rollable members that would be in the channel means below the slots, the channel means forming a path featuring a plurality of geometrical patterns, one or more of said patterns intersecting at least another of the patterns, and means for determining the direction for the one or more rollable members mounted in said channel means at the intersecting of the one or more of said patterns with at least another of the patterns.

15. The toy of claim 14 wherein said determining means comprises a pivotal gate in the form of a pointer having a free end, a length and a width on the pointer, either its free end or length blocking one or the other of channel means forming the patterns intersecting one another.

16. The toy of claim 14 wherein said channel means includes channel linkages, said determining means positioned in said toy in said channel linkages.

17. The toy of claim 16 wherein said determining means comprises a pivotal gate in the form of a pointer having a free end, a length and a width on the pointer, either its free end or length blocking one or the other of channel means forming the patterns intersecting one another.

18. The toy of claim 14 or claim 15 or claim 16 or claim 17 wherein one of said patterns comprises a circularly-formed pattern.

19. The toy of claim 14 or claim 15 or claim 16 or claim 17 wherein one of said patterns comprises a spirally-wound pattern.

20. The toy of claim 14 or claim 15 or claim 16 or claim 17 wherein one of said patterns comprises a wavy pattern.

21. The toy of claim 14 or claim 15 or claim 16 or claim 17 wherein one of said patterns comprises a snake-like pattern.

22. The toy of claim 14 or claim 15 or claim 16 or claim 17 wherein one of said patterns comprises a sinusoidal configuration.

23. The toy of claim 14 or claim 15 or claim 16 or claim 17 wherein one of said patterns comprises a straight configured pattern.

24. The toy of claim 1 or claim 2 or claim 14 or claim 16 including means mounted in one of said one or more of said patterns for deflecting one or more rollable members in one direction rather than in another direction in the same one of said one or more of said patterns.

25. The toy of claim 24 wherein said deflecting means comprises a delineated mesa.

* * * * *

UNITED STATES PATENT AND TRADEMARK OFFICE

CERTIFICATE OF CORRECTION

PATENT NO. : 5,314,367

DATED : May 24, 1994

INVENTOR(S) : SCHAEFER, Nicholas E.

It is certified that error appears in the above-identified patent and that said Letters Patent is hereby corrected as shown below:

In column 7, line 4, read "of" as - - on - - .

Signed and Sealed this

Twentieth Day of December, 1994

*Attest:*

*Attesting Officer*

Bruce Lehman

BRUCE LEHMAN

*Commissioner of Patents and Trademarks*